US005470147A

United States Patent [19]

Duckworth

[11] Patent Number: 5,470,147

[45] Date of Patent: Nov. 28, 1995

[54] PORTABLE CONTINUAL MIXER

[76] Inventor: Donald L. Duckworth, 702 Columbia St. NE., Roanoke, Va. 24016

[21] Appl. No.: 269,530

[22] Filed: Jul. 1, 1994

[51] Int. Cl.[6] ..... B28C 7/14; B01F 15/02

[52] U.S. Cl. ..... 366/34; 366/35; 366/38; 366/40; 366/64; 366/156.1; 366/158.1

[58] Field of Search ..... 366/8, 10, 33, 366/34, 35, 38, 40, 64, 156, 157, 158, 167, 168, 177, 181, 194, 195, 196, 318, 322, 156.1, 158.1

[56] References Cited

U.S. PATENT DOCUMENTS

| | | | |
|---|---|---|---|
| 1,753,716 | 4/1930 | Owen | 366/38 |
| 2,276,237 | 3/1942 | Lowry | 366/34 |
| 3,469,824 | 9/1969 | Futty | 366/64 |
| 4,298,288 | 11/1981 | Weisbrod | 366/8 |
| 4,566,799 | 1/1986 | Ito | 366/40 |
| 5,213,414 | 5/1993 | Richard | 366/34 |

*Primary Examiner*—Robert W. Jenkins
*Attorney, Agent, or Firm*—Terrance L. Siemens

[57] ABSTRACT

A portable continual mixer blends dry powdered material with an aggregate and a liquid. The ingredients may be cement, sand, and water. The batch mixer has two screw augers. The first auger feeds dry mix into an elongated mixing chamber, and has its own electric motor and speed control. The second auger mixes the dry and liquid mix constituents, and conducts blended mixture to a discharge port located at the end of the elongated mixing chamber. The blade of the second auger is formed in three sections. In respective order, these sections include a first section wherein the blade is configured as a screw auger; a second section wherein the blade has paddles pitched to urge the mixture onward to the third section; and a third section which, like the first section, includes a blade configured as a screw auger. The liquid is metered by a valve controlled in accordance with the feed rate of the solid constituents. A predetermined proportion of dry and liquid constituents is thus maintained. The second auger mixes dry and liquid constituents, and discharges a final blended mixture. The housing of the mixing chamber is longitudinally split, so that it is readily opened and quickly cleaned after operation is complete. The novel batch mixer is particularly suited for preparing small quantities of mixture, and produces little waste. The housing of the mixing chamber is split for ready separation and cleaning.

5 Claims, 2 Drawing Sheets

PORTABLE CONTINUAL MIXER

BACKGROUND OF THE INVENTION

1. Field of the Invention

The present invention relates to a mixer capable of mixing and dispensing relatively small quantities of cement and concrete in a continuous manner. As such it is generally applicable to the many fields of construction that utilize concrete. More generally the invention could find use in any field requiring the mixing of one or more aggregate or powdered solids with a fluid to produce a slurry or mixed composite in a continuous manner.

It should be noted that although a principal application of the invention is to mixing concrete, cement, and mortar, the principles embodied herein are suitable for mixing any type of powdered or granular solid with a liquid. Examples include preparing batter, ceramic mixes such as slip, plaster, and paint; mixing resins and curing or hardening agents; and conditioning soil, as for planting. These are but several examples of possible applications.

Thus it can be seen that the potential fields of use for this invention are myriad and the particular preferred embodiment described herein is in no way meant to limit the use of the invention to the particular field chosen for exposition of the details of the invention.

A comprehensive listing of all the possible fields to which this invention may be applied is limited only by the imagination and is therefore not provided herein. Some of the more obvious applications are mentioned herein in the interest of providing a full and complete disclosure of the unique properties of this previously unknown general purpose article of manufacture. It is to be understood from the outset that the scope of this invention is not limited to these fields or to the specific examples of potential uses presented hereinafter.

2. Description of the Prior Art

Mixers for preparing mixes of solids in powdered or aggregate form and a liquid are old. Such mixers are typically employed to prepare batter and dough for baking, concrete and cement for building, resins for manufacturing, and similar mixtures wherein two or more raw materials are blended to prepare a homogeneous material for ultimate use. Mixers generally include a receptacle to hold the mixture, a beater or agitator to blend the constituent materials, and a chute or analogous structure for dispensing the final mixture.

U.S. Pat. No. 4,223,996, issued to Paul Mathis et al. on Sep. 23, 1980, discloses a mixer having a single auger or feedscrew which urges mix material into a mixing chamber and then to a discharge port. It is noted the inlet chamber of Mathis et al. is of variable diameter, and small quantities of cement mix or sand could become trapped, and could be removed only upon cleaning the mixer. By contrast, the mixing chamber of the instant invention has a constant diameter, which avoids entrapping small quantities of mixed cement, or constituents.

German Patent Document No. 31 42-053 A1, by Wachter et al., dated May, 1985, discloses a similar mixer with abruptly changing chamber diameters. By contrast the mixing chamber of the instant invention has a constant diameter for ease of use and cleaning.

A mixer comprising paddles mounted on a rotating shaft is seen in U.S. Pat. No. 2,298,258, issued to William J. Ziler on Oct. 6, 1942. This mixing apparatus is located in a chamber dedicated exclusively to mixing, and action of the paddles pushes the mixed product towards another chamber. The mix is drawn from this second chamber for dispensing through a pipe.

Another arrangement wherein paddles agitate the constituent ingredients into a homogeneous, blended mix is seen in U.S. Pat. No. 2,276,237, issued to Ronald P. Lowry on Mar. 10, 1942. In Lowry's device, dry, powdered cement is gravity fed from a hopper into a conveyor including a screw auger, and propelled towards a vertical conduit. Water is arranged to be introduced to the dry mix in a conduit forming an annulus surrounding the vertical conduit. Water is metered in Lowry's device by a metering pump which is driven by fixed connection to the screw auger shaft.

The dry mix and water are discharged into a mixing chamber having paddles fixed to a rotating shaft. The dry and wet constituents are mixed as they migrate toward the end of this mixing chamber. The final, prepared mix is discharged through an opening formed in the floor of the mixing chamber at the end thereof, and held in a storage tank. As in the case of Ziler, a pipe draws the mix from this storage tank for dispensation and use.

U.S. Pat. No. 2,296,505, issued to Kent B. Diehl on Sep. 22, 1942, describes a trailer mounted mixer having a single shaft screw auger mixer. Dry constituents are loaded into a hopper which discharges into the screw auger housing. The auger propels the dry mix towards the end of the housing, whereupon the mix drops through an opening formed in the floor into a discharge conduit. This discharge conduit has a first vertical leg, a second horizontal leg, and a final vertical leg. Water is metered by an adjustable valve, and the metered flow thereof is introduced into the discharge conduit at the elbow between the first vertical leg and the second horizontal leg. It should be noted that the screw auger functions purely as a conveyor, and no mechanical agitating apparatus is provided to blend the water and dry mix after these two materials have been fed into a common conduit or chamber.

None of the above inventions and patents, taken either singly or in combination, is seen to describe the instant invention as claimed.

SUMMARY OF THE INVENTION

The present invention provides a mixer having a single mixing and conveying chamber of constant cross sectional dimension, and having a singular rotating shaft. The screw auger incorporating this shaft serves as both a conveyor and a mixer. This is accomplished by modifying the auger helical blade such that a central portion has portions removed. The pattern of partial blade alternating with gaps serves as a mixer, while continuing to propel the mixture through the chamber. The central portion is followed by another portion of full blade construction, so that the mixed fluent mass is efficiently conducted to the end of the chamber.

Thus, the auger helical blade is characterized by having three distinctive sections, each configured differently from its neighbor. A first section has a conventional screw configuration for conveying. The second section comprises separate paddles, for mixing. The pitch of these paddles is essentially similar to that of the screw, so that the material being mixed will continue to migrate in the direction of flow caused by the first section. The final section also comprises a screw for conveying.

The fluent solid and water are separately introduced into the mixing chamber. Each is fed in proportion to the other. A first screw conveyor driven by its own motor is provided which meters dry mix into the chute. The mix is discharged, as described above, into the mixing chamber at the first, conveying section thereof. Water is introduced into the mixing chamber at the point at which the auger blade makes transition to its second section. The water is metered by a simple hand operated faucet valve. Optionally, the water may be metered by a control valve which is opened in proportion to the speed of the dry mix feed auger.

Water and dry mix are substantially blended in the mixing chamber at the second section having paddles, and pass to the third section for discharge.

A discharge port is formed in the bottom and at the end of the mixing chamber, and the mixture is ready for use immediately upon discharge.

An important element in the invention, apart from the aforementioned modification to the auger blade, is the provision of separate motors for the main mixing auger and for the dry mix feed auger. The appropriate amount of mix can therefore be metered without being dependent upon the speed of the mixing auger.

Another advantageous feature is that the housing of the main mixing and conveying chamber is longitudinally split. This enables easy washing after concrete mixing has been completed.

The novel arrangement is capable of preparing limited quantities of concrete, so that there is little waste.

Accordingly, it is a principal object of the invention to provide a new and improved nested cart pushing device which overcomes the disadvantages of the prior art in a simple but effective manner.

It is a major object of the invention to provide a mixer which can mix and dispense small continuous batches with little or no waste.

It is another object of the invention to meter solid, powdered material and a liquid in predetermined proportion.

It is a further object of the invention to operate the feed auger at a rate which is independent of the rotational speed of the mixing auger.

It is an additional object of the invention to provide a mixing chamber of constant cross sectional diameter.

It is again an object of the invention to provide a mixing chamber housing which is readily opened, as for cleaning.

Yet another object of the invention is to be able to adjust the speed of the feed auger.

Still another object of the invention is to provide separate motors for the feed auger and the mixing auger.

A still further object of the invention is to provide a portable, continuously operating mixer.

Yet another object of the invention is to power the mixing auger by a small internal combustion engine, and to power the feed auger by an electric motor.

Still another object of the invention is to reduce the output speed of the internal combustion engine, thereby driving the mixing auger at a reduced speed with respect to the internal combustion engine.

It is a general goal of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

The present invention meets or exceeds all the above objects and goals. Upon further study of the specification and appended claims, further objects and advantages of this invention will become apparent to those skilled in the art.

BRIEF DESCRIPTION OF THE DRAWINGS

Various other objects, features, and attendant advantages of the present invention will become more fully appreciated as the same becomes better understood when considered in conjunction with the accompanying drawings, in which like reference characters designate the same or similar parts throughout the several views, and wherein.

Similar reference characters denote corresponding features consistently throughout the attached drawings.

DETAILED DESCRIPTION OF THE PREFERRED EMBODIMENTS

Figure 1:
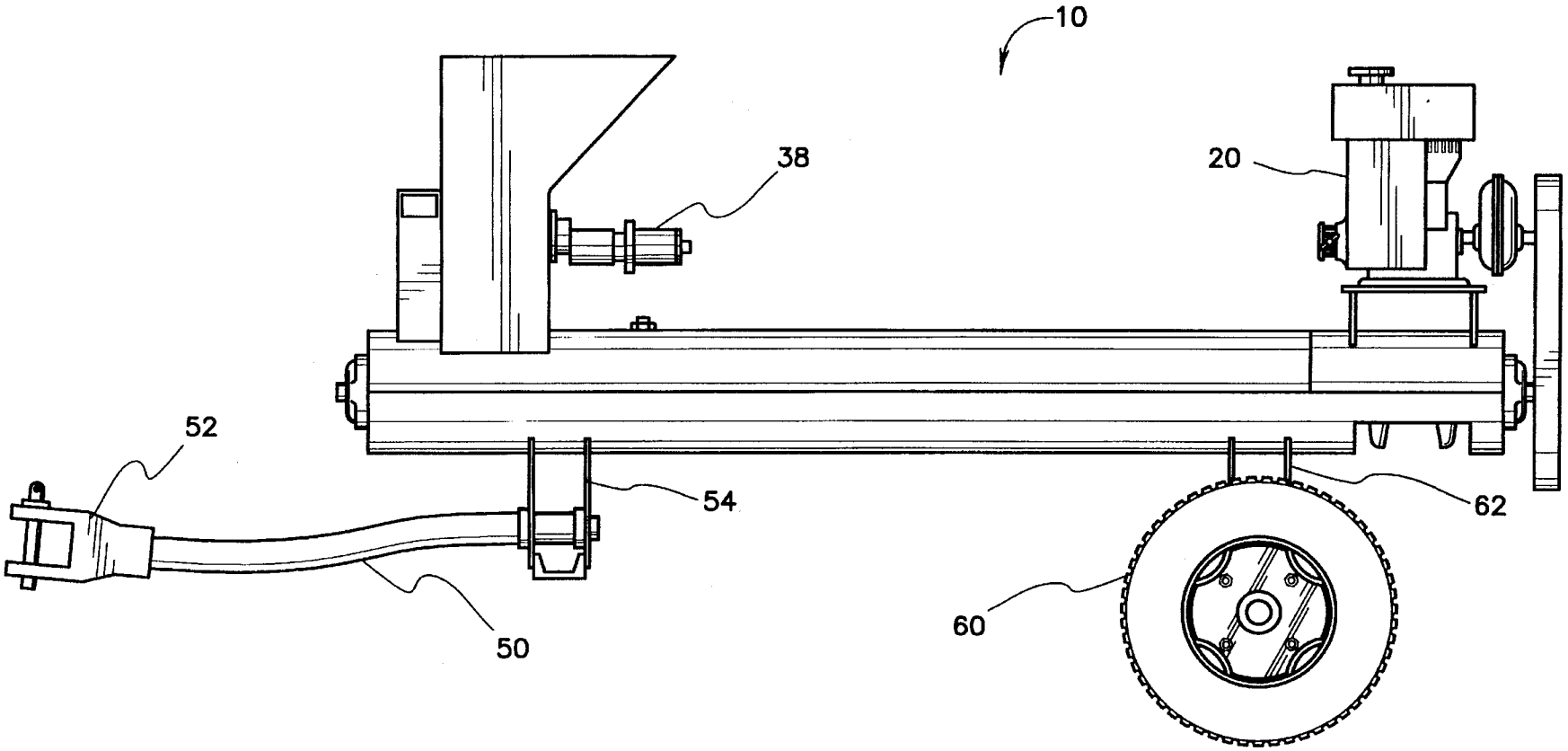
FIG. 1 is an environmental side view of the overall invention adapted as a mobile apparatus.

FIG. 1 is an environmental side view of the cement mixer of the instant invention indicated generally at 10. The preferred embodiment shows the mixer mounted on wheels 60 by running gear 62. Wheels 60 and running gear 62 are placed somewhat near the longitudinal center of gravity of the overall unloaded unit so as to provide balance for towing. Towing is accomplished by tongue 50 having a hitch unit 52 near the front and mounting means 54 near the rear. Details of the hitch and tow tongue mounting means are conventional and not further described here. Power is provided for operating the unit by electric motor 38 and internal combustion engine 20, both described more fully later.

Figure 2:
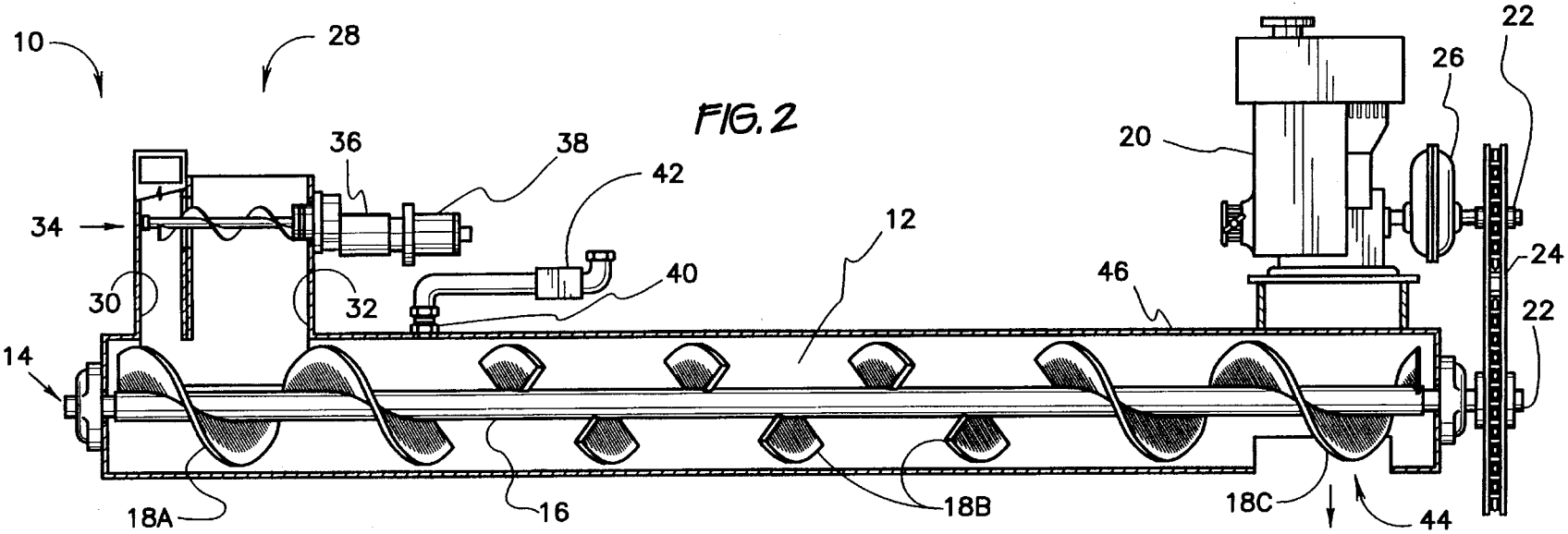
FIG. 2 is a diagrammatic, side elevation view of the novel mixer, shown partly in cross section.

As seen in FIG. 2, the novel cement mixer 10 is characterized by an elongated main mixing chamber 12. Mixing chamber 12 has a constant diameter, which avoids entrapping small quantities of mixed cement, or constituents. By contrast, the inlet chamber of Mathis et al. '966 is of variable diameter, and small quantities of cement mix or sand could become trapped, and would be removed only upon cleaning the mixer.

Returning to novel mixer 10, a main auger 14 passes through mixing chamber 12. Main auger 14 includes a central shaft 16 and a blade 18. Blade 18 is divided into three sections 18A, 18B, and 18C. In a first section 18A, the blade describes a continuous helix about shaft 16. This portion 18A of blade 18 acts as a conveyor, propelling fluent solids to the right, as seen in this Figure.

In the second portion, the blade is partially cut away, so that the remaining parts describe paddles 18B. Paddles 18B effectively mix the powdered constituents and a liquid, which will be further described hereinafter. As the pitch of portion 18A is maintained in paddles 18B, paddles 18B also urge the fluent mass to the right.

The third section 18C of the blade is configured similarly to first section 18A. The fully mixed constituents are urged to the right thereby.

At the right of this Figure, a single cylinder internal combustion engine 20 is mounted, and drives shaft 16 through an arrangement of sprockets 22 and chain 24. Engine 20 is of any suitable type typically provided for operating small appliances, such as lawn mowers. A geared speed reducer 26 enables auger 14 to turn at a low speed, while engine 20 operates efficiently at a higher speed.

At the left, a hopper 28 is provided for supplying powdered or fluent solids into mixing chamber 12. Hopper 28 includes two chutes 30,32. The first chute 30 is relatively small, and communicates with a feed auger 34. Feed auger 34 is driven by an electric motor 36 by an adjustable controller 38, such as a variable frequency controller. Feed auger 34 feeds cement mix into chute 30.

Larger chute 32 does not have a powered feed device, It opens to mixing chamber 12, and is employed to feed aggregates such as sand and gravel into the cement mix.

Water is introduced into mixing chamber 12 at a fitting 40. In the preferred embodiment the water flow is manually controlled as by any conventional water tap valve. As the proportion of water to cement mix is critical, it is envisioned this proportion could be maintained by linking the speed of electric motor 36 to a liquid metering device 42 controlling the rate of water feed. This is accomplished in any suitable way. In one embodiment, device 42 may be a second electric motor for operating a water pump. The speed of the water pump would be the same as the speed of feed auger 34. In another embodiment, device 42 may be an electrically operated valve, the degree of opening being responsive to the output of controller 38. Still other arrangements may be employed to maintain the proportion of cement mix to water.

Mixed constituents are urged to the right of mixing chamber 12. An opening 44 is formed at the bottom of housing 46 enclosing mixing chamber 12. Mixed cement, concrete, mortar, or other product is gravity discharged from mixer 10 through this opening 44 into an awaiting receptacle (not shown), for subsequent transport to the point of use.

Figure 3:
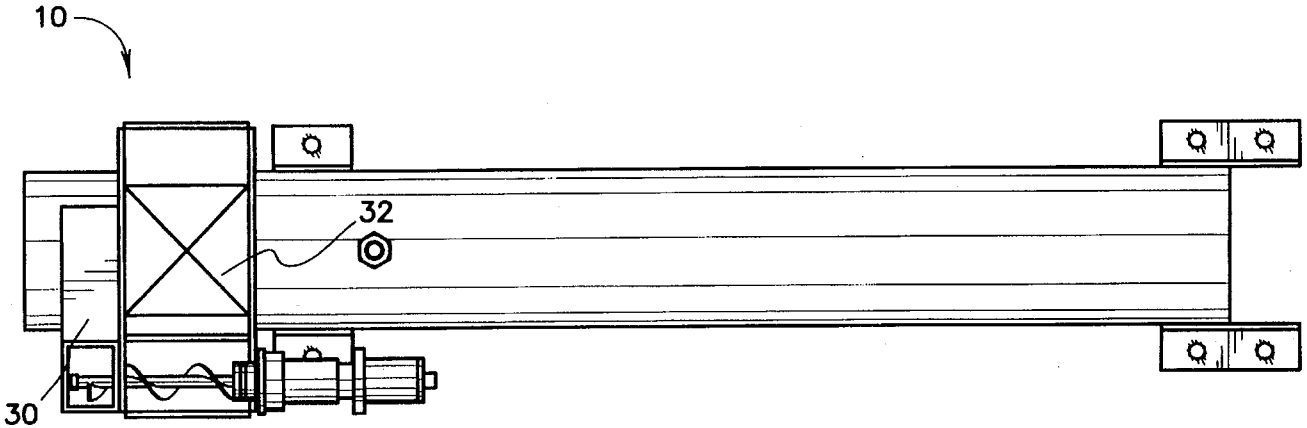
FIG. 3 is a diagrammatic, top plan view of the novel mixer.

The openings of chutes 30 and 32 are better seen in FIG. 3. Bulk solids are easily loaded into the hopper through these openings.

Figure 4:
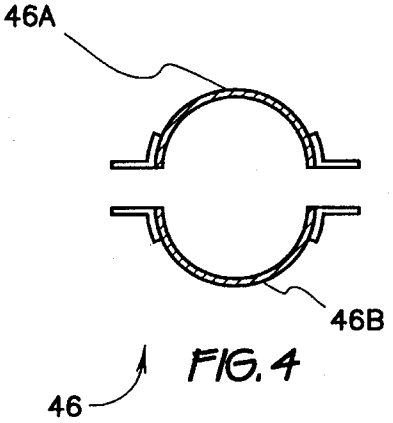
FIG. 4 is a cross sectional detail view of the mixing chamber housing.

As seen in FIG. 4, housing 46 is split longitudinally into two sections 46A and 46B. Upper section 46A may be lifted from lower section 46B, so that the inner surfaces of housing 46 and auger 14 can be readily cleaned, as by a garden hose (not shown).

To use mixer 10, a suitable source of clean water (not shown), such as the garden hose, is connected to water control device 42. Hopper 28 is charged with appropriate materials. Engine 20 is started, and runs continuously. When electric motor 36 is started, the mixing process starts, and runs until the demand for the mixed product is satisfied. Hopper is refilled as required, and operation need not be interrupted. When sufficient product has been mixed, engine 20 and electric motor 36 are shut off. Housing 46 is opened and cleaned, and mixer 10 is substantially ready for transporting to the next job.

Thus, a compact, portable mixer is disclosed, which mixer operates continuously, prepares small continuous batches, and produces little waste.

It is to be understood that the present invention is not limited to the embodiments described above, but encompasses any and all embodiments within the scope of the following claims.

I claim:

1. A portable continual mixer for mixing dry, granular or powdered material with a liquid, comprising:

a feed auger having a first motor driving said feed auger, said feed auger for feeding the powdered material; and a mixing chamber comprising a housing and a mixing auger disposed within, said mixing auger disposed to receive powdered material from said feed auger, and further having a second motor for driving said mixing auger, and a blade having a first section having a continuous screw blade and a second section and a second section having paddles arranged at a pitch urging the powdered material and liquid to migrate in the same direction as urged by said first section, said mixer blade further having a third section disposed after said first section and said second section, said third section characterized by a second continuous screw blade having a pitch urging the powdered material and liquid to move in the same direction as urged by said first blade section.

2. A portable continual mixer for mixing dry, granular or powdered material with a liquid, comprising.

a feed auger having a first motor driving said feed auger, said feed auger for feeding the powdered material; and a mixing chamber comprising a housing and a mixing auger disposed within, said mixing auger disposed to receive powdered material from said feed auger, and further having a second motor for driving said mixing auger, and a blade having, in respective order, a first section and a second section, said first section having a continuous screw blade, and said second section having paddles arranged at a pitch urging the powdered material and liquid to migrate in the same direction as urged by said first section, wherein said housing is split longitudinally into an upper section and a lower section, whereby said upper section is removable to enable cleaning of said mixing chamber.

3. A portable continual mixer for mixing dry, granular or powdered material with a liquid, comprising:

a feed auger having a first motor driving said feed auger, said feed auger for feeding the powdered material;

a mixing chamber of constant diameter, comprising a housing longitudinally split into upper and lower sections, and a mixing auger disposed therewithin, said mixing auger disposed to receive powdered material from said feed auger, and further having a second motor for driving said mixing auger, and a blade having, in respective order, a first section, a second section, and a third section, said first section having a continuous screw blade, and said second section having paddles arranged at a pitch urging the powdered material and liquid to migrate in the same direction as urged by said first section, said third section having a second continuous screw blade;

a liquid metering device controlling liquid being introduced to said mixer;

a chute accepting powdered material fed by said feed auger, and discharging the powdered material to said mixer; and a second chute for feeding a second powdered material by gravity to said mixer.

4. The portable continual mixer according to claim 3, said first motor comprising an electric motor directly driving said feed auger, said second motor comprising a single cylinder internal combustion engine.

5. The portable continual mixer according to claim 3, further comprising speed control means for operating said first motor selectively at varying speeds, whereby said feed auger operates at variable speeds with respect to said mixing auger.

* * * * *